US010023923B2

(12) United States Patent
Toumi

(10) Patent No.: US 10,023,923 B2
(45) Date of Patent: Jul. 17, 2018

(54) METHOD AND DEVICE FOR TREATING A METAL OR A MOLTEN METAL ALLOY USING AN ADDITION AGENT

(71) Applicant: Mourad Toumi, Saint Maximin (FR)

(72) Inventor: Mourad Toumi, Saint Maximin (FR)

( * ) Notice: Subject to any disclaimer, the term of this patent is extended or adjusted under 35 U.S.C. 154(b) by 282 days.

(21) Appl. No.: 14/896,634

(22) PCT Filed: Jun. 6, 2014

(86) PCT No.: PCT/EP2014/061830
§ 371 (c)(1),
(2) Date: Dec. 7, 2015

(87) PCT Pub. No.: WO2014/198662
PCT Pub. Date: Dec. 18, 2014

(65) Prior Publication Data

US 2016/0115561 A1 Apr. 28, 2016

(30) Foreign Application Priority Data

Jun. 10, 2013 (FR) ..... 13 55332

(51) Int. Cl.
*F27D 3/00* (2006.01)
*C21C 7/00* (2006.01)
(Continued)

(52) U.S. Cl.
CPC ..... *C21C 1/105* (2013.01); *B22C 9/103* (2013.01); *B22D 1/00* (2013.01); *C21C 7/0006* (2013.01);
(Continued)

(58) Field of Classification Search
CPC ..... C21C 7/0006; C21C 7/0075
(Continued)

(56) References Cited

U.S. PATENT DOCUMENTS 4,509,979 A * 4/1985 Bauer ..... C21C 1/10 266/216
2004/0195739 A1* 10/2004 Sillen ..... B22D 1/00 266/216
2012/0152060 A1* 6/2012 Berthelet ..... B22D 41/04 75/414

FOREIGN PATENT DOCUMENTS

DE 1 508 264 A1 10/1969
DE 25 40 142 A1 4/1977
(Continued)

OTHER PUBLICATIONS

French Search Report and Written Opinion dated Feb. 24, 2014, issued in corresponding French Application No. 1355332, filed Jun. 10, 2013, 6 pages.
(Continued)

*Primary Examiner* — Scott Kastler
(74) *Attorney, Agent, or Firm* — Christensen O'Connor Johnson Kindness PLLC

(57) ABSTRACT

A method and device for treating a metal or a molten metal alloy using an addition agent, wherein the addition agent is deposited in a local cavity arranged at the bottom of a treatment ladle and surrounded by a protruding wall, and a closing member connected to movement means is able to form, with the bottom of the treatment ladle, in a low insulating position, a chamber including said local cavity and comprising an intermediate annular space around the small wall. Application to the treatment of a molten cast iron using pure magnesium or magnesium alloy.

11 Claims, 7 Drawing Sheets

(51) Int. Cl.

| | |
|---|---|
| ***C21C 1/10*** | (2006.01) |
| ***B22C 9/10*** | (2006.01) |
| ***B22D 1/00*** | (2006.01) |
| ***C22B 9/10*** | (2006.01) |
| ***F27B 14/10*** | (2006.01) |
| *F27B 14/08* | (2006.01) |

(52) U.S. Cl.
CPC ..... *C21C 7/0075* (2013.01); *C22B 9/10* (2013.01); *C22B 9/103* (2013.01); *F27B 14/10* (2013.01); *F27D 3/0033* (2013.01); *F27B 2014/0862* (2013.01); *F27B 2014/106* (2013.01)

(58) Field of Classification Search
USPC ..... 266/216
See application file for complete search history.

(56) References Cited

FOREIGN PATENT DOCUMENTS

| | | | |
|---|---|---|---|
| EP | 424 604 | A1 | 5/1990 |
| FR | 1113491 | A | 3/1956 |
| FR | 1398505 | A | 5/1965 |
| GB | 713469 | A | 8/1954 |
| GB | 1 328 995 | A | 9/1973 |
| JP | 60-102266 | A | 6/1985 |

OTHER PUBLICATIONS

International Search Report and Written Opinion dated Sep. 16, 2014, issued in corresponding International Application No. PCT/EP2014/061830, filed Jun. 6, 2014, 11 pages.

* cited by examiner

METHOD AND DEVICE FOR TREATING A METAL OR A MOLTEN METAL ALLOY USING AN ADDITION AGENT

The present invention relates to the field of treating a molten metal or metal alloy using an additive agent.

In particular cast iron is a well-known iron-carbon alloy that is widely used for the manufacture of mechanical parts.

Without particular treatment, graphite is included in the structure in the form of lamellae in the cast-iron mechanical parts, to such an extent that the latter are very brittle.

It is described in U.S. Pat. No. 2,485,760 and U.S. Pat. No. 2,529,346 that the introduction into the molten cast iron of a vaporizable substance such as pure magnesium or a suitable magnesium alloy gives rise to a violent reaction that makes it possible to obtain mechanical parts made of spheroidal or nodular graphite cast iron that have an increased ductility.

In order to carry out this introduction, various methods are known today.

Patent GB 1 503 226 mentions a method in which the magnesium deposited at the bottom of a ladle is covered with scrap iron before introducing the cast iron thereinto and describes a method in which the magnesium is introduced into a chamber delimited by a false bottom parallel to the bottom of the ladle and having an opening at one end.

U.S. Pat. No. 3,747,912, U.S. Pat. No. 5,098,651 and EP 2 251 443 describe casting ladles provided, in the bottom, with a chamber that has holes. In a first step, the casting ladle being placed in a horizontal position, magnesium or a magnesium alloy is introduced into the chamber and the casting ladle is partially filled with molten cast iron, said chamber being located above the level of the molten cast iron. In a second step the casting ladle, which is closed by a cover, is pivoted in order to bring it into a vertical position, so that the magnesium or the magnesium alloy comes into contact with the molten cast iron through the holes of the chamber and gives rise to the desired reaction.

U.S. Pat. No. 3,703,922 and FR 2 421 948 describe methods in which molten cast iron is treated with magnesium or a magnesium alloy directly in the mold of the part to be obtained.

Another known method consists in rapidly submerging, in the molten cast iron, a perforated receptacle containing magnesium or a magnesium alloy.

Another method consists in gradually introducing, via the surface of the molten cast iron, a steel sheath containing magnesium or a magnesium alloy. The melting of the steel sheath leads to the magnesium or the magnesium alloy being brought into contact with the molten cast iron and to the reaction.

Some of the above methods may also be applied to the treatment of a steel using calcium, a ferrosilicon or a silicon-calcium alloy that makes it possible to improve its cold formability. Teachings on this subject are described in patents FR 2 552 107 and WO 86/02949.

Furthermore, patent GB 713 469 describes a casting ladle, the flat bottom of which has a recessed cavity for receiving an additive agent and which is provided with a vertically movable plate that may be placed over the bottom in order to close the cavity before introducing the metal into the ladle. When this plate is lifted, the metal is brought into contact with the additive agent.

The objective of the present invention is to improve the conditions and means for treating a metal or metal alloy using an additive agent.

Firstly, a process is proposed for treating a molten metal or metal alloy using an additive agent.

According to one embodiment, this process comprises: depositing the additive agent in at least one local cavity made in the bottom of a treatment ladle and delimited by a low annular wall that protrudes with respect to this bottom, lowering down to a bottom position at least one closure member comprising a closure bell so that this closure bell surrounds, at a distance, said low wall and so that its frontal edge bears against the bottom of the treatment ladle, creating an annular bearing zone around and at a distance from the low wall and that is located below the upper edge of the low wall and forming a chamber that includes said local cavity and an intermediate annular space surrounding said low wall, at least partially filling the treatment ladle with the molten metal, raising the closure member so as to bring the molten metal and the additive agent into contact.

Thus, in particular, the reaction occurs at depth in the metal and spreads out and the initiation thereof can be easily controlled. Furthermore, the low wall forms an obstacle that prevents possible leaks of metal, capable of penetrating into said chamber by passing through said annular bearing zone when the closure bell is in the lowered position, from reaching the additive agent contained in the cavity.

The process may be applied to the treatment of a molten cast iron using pure magnesium or a magnesium alloy, to the treatment of a molten steel using calcium metal, a ferrosilicon or a silicon-calcium alloy, or to the treatment of aluminum or an aluminum alloy using titanium, boron, sodium or an alloy containing at least one of the latter.

A device is also proposed for treating a molten metal or metal alloy using an additive agent.

According to one embodiment, this device comprises a treatment ladle, wherein at least one local cavity is made in the bottom of the treatment ladle and that comprises added equipment comprising at least one closure member and displacement means for moving this closure member to and from a bottom position for isolating or closing said local cavity.

The bottom of the treatment ladle has a protruding low annular wall that delimits said local cavity.

The lower portion of the closure member comprises a closure bell which, in said bottom position, is capable of surrounding, at a distance, said low wall and the frontal edge of which, in said bottom position, is capable of bearing against the bottom of the treatment ladle, creating an annular bearing zone around and at a distance from the low wall and that is located below the upper edge of the low wall, so as to form a chamber that includes said local cavity and an intermediate annular space surrounding said low wall.

The closure member may comprise a suspension arm connected to said displacement means and a lower portion having a lower annular edge that bears, in said isolating bottom position, against a zone of the bottom of the treatment ladle, extending around said local cavity.

The lower portion of the closure member may comprise a closure bell.

The bottom of the treatment ladle may have a protruding low annular wall that delimits said local cavity.

The closure member may extend through a passage of a cover portion for at least partial closure of the treatment ladle.

The added equipment may comprise guide means for guiding the closure member.

The closure member may be rigidly connected to said displacement means.

The displacement means may comprise means for exerting a force for applying the closure member, over the bearing zone of the latter, against the bottom of the treatment ladle.

The bearing zone of the closure member against the bottom of the treatment ladle may be provided with a sealing layer.

Treatment devices will now be described by way of nonlimiting examples, illustrated by the drawing in which.

Figure 1:
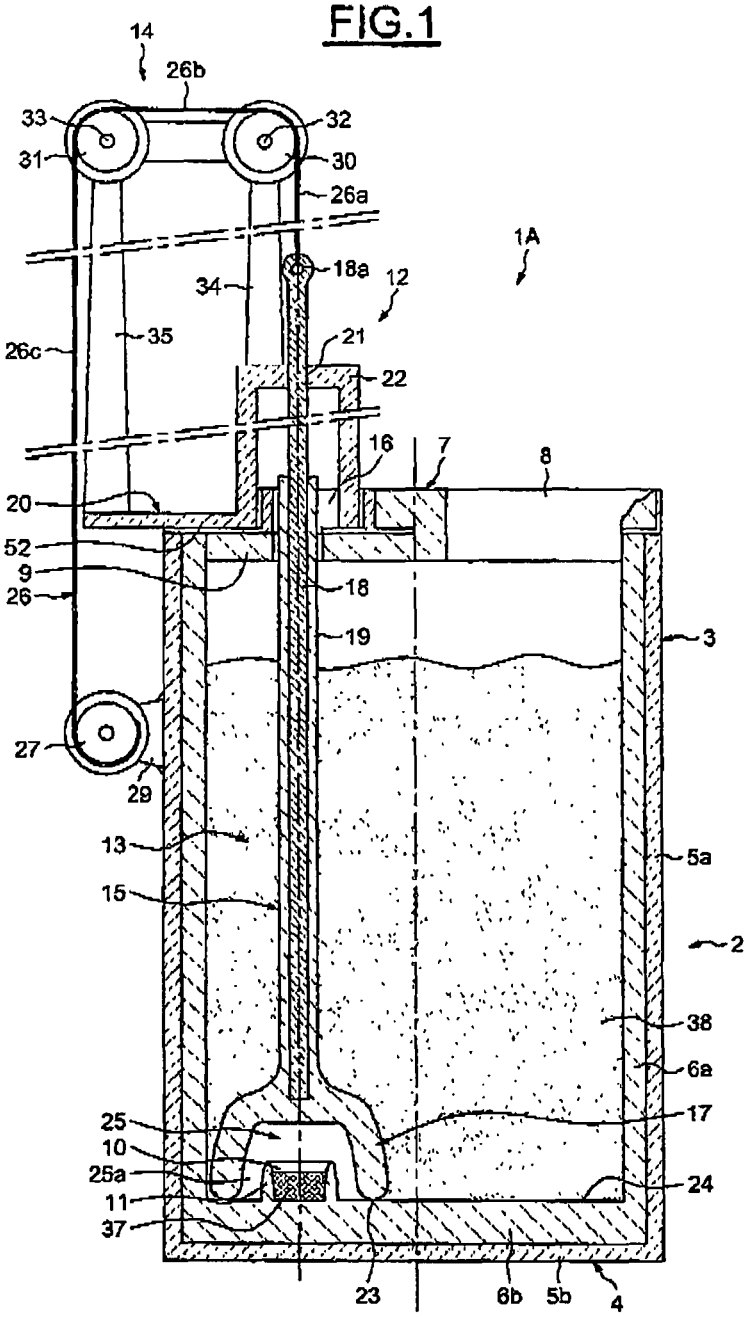
FIG. 1 represents a vertical section of a treatment device, according to one stage of use.
Figure 2:
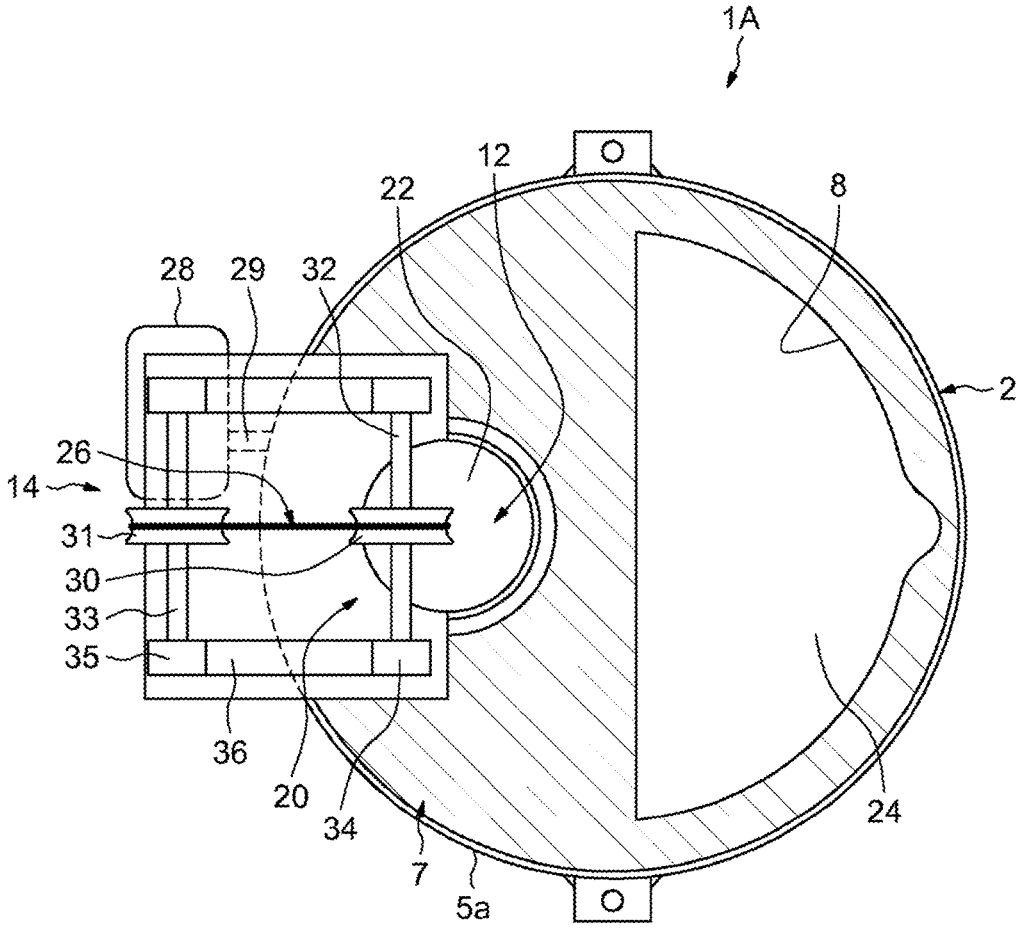
FIG. 2 represents a top view of the treatment device from FIG. 1.

As illustrated in FIGS. 1 and 2, a device 1A for treating a molten metal using an additive agent comprises a treatment ladle 2 that comprises a peripheral wall 3, for example that is cylindrical or frustoconical, of circular, square or rectangular cross section, and a bottom 4, for example that is radial and flat.

The peripheral wall 3 and the radial bottom 4 respectively comprise a metallic outer shell 5*a* and 5*b* and an internal coating 6*a* and 6*b* made of a refractory material.

The treatment ladle 2 is provided with a cover portion 7 that makes a reduced upper opening 8 that extends for example over half of the cross section of the peripheral wall 3. The cover portion 7 comprises a metal core 52, which is attached to the upper end of the shell 5*a*, and a coating 9 made of a refractory material at least on the inside of the treatment ladle 2, which is joined to the coating 6*a*.

At the bottom of the treatment ladle 2, at a distance from the peripheral wall 3 and opposite the cover portion 7, a local cavity 10 is made which is delimited by a low annular wall 11 that protrudes above the bottom 4 and is formed by an upward extension of the internal coating 6*b*.

The treatment ladle 2 is provided with added equipment 12 that comprises a closure member 13 and displacement means 14 for moving this closure member 13.

The closure member 13 comprises a suspension arm 15 that extends into the treatment ladle 2 along an axis parallel to the axis of the treatment ladle 2 and aligned with the axis of the local cavity 10 and which freely passes through a passage 16 made through the cover portion 7.

On the inside of the treatment ladle 2, the closure member 13 comprises, at the lower end of the suspension arm 15, a lower closure portion 17 in the form of a hermetic bell that is intended to close off the cavity 10.

The suspension arm 15 comprises a metal axial shaft 18 surrounded by a coating 19 made of a refractory material that is extended so as to form the hermetic closure bell 17.

The added equipment 12 comprises a support 20 which is attached to the metal core 52 of the cover portion 7, on the opposite side from the opening 8.

The upper portion of the shaft 18, which is free of refractory coating, extends through a guide passage 21 of a radial portion 22 of the support 19 located at a distance above the cover portion 7, so that the closure member 13 can be moved parallel to the axis of the treatment ladle 2 by being guided by the guide passage 20.

When the closure member 13 is in a bottom position for isolating the cavity 10 (FIG. 1), the hermetic closure bell 17 covers and surrounds, at a distance, the low wall 11. The frontal edge of the closure bell 17 and the bottom 4 of the treatment ladle 2, more particularly the inner face 24 of the coating 6*b*, together create an annular bearing zone 23, around and at a distance from the low wall 11, so that the hermetic closure bell 17 and the bottom 4 of the treatment ladle 2 delimit a leaktight or hermetic chamber 25 that includes the local cavity 10, the materials being selected being adapted so that this chamber 25 is leaktight or hermetic.

Thus, the low wall 11 extends by protruding upward with respect to the annular bearing zone 23, which is thus located below the annular upper edge of the low wall 11 and the chamber 25 comprises an intermediate annular space 25*a* that surrounds the low wall 11 and that is located below the annular upper edge of the low wall 11.

In said isolating bottom position, the upper portion of the coating 19 of the suspension arm 15 extends into the passage 16 of the cover portion 7 and is at a distance from the radial portion 22 of the support 19.

The displacement means 14 comprise a cable 26, one end of which is attached to the upper end 18*a* of the shaft 18 of the closure member 13 and which comes from a reel 27 that may be rotated by a gear motor 28, the housing of which is attached against the outer face of the shell 5*a* of the peripheral wall 3 of the treatment ladle 2, on the side of the cover portion 7, by means of a bracket 29.

The strand of the cable 26, between the attachment upper end 18*a* and the reel 27, is diverted by free rotating pulleys 30 and 31 borne by parallel axles 32 and 33, the ends of which are mounted on the ends of pairs of vertical arms 34 and 35 of the support 20, extending upward and connected by crosspieces 36.

The pulleys 30 and 31 are positioned so that said strand of the cable 26 has a vertical portion 26*a* between the attachment upper end 18*a* and the pulley 30, a horizontal portion 26*b* between the pulleys 30 and 31 and a vertical portion 26*c* between the reel 27 and the pulley 31.

In said isolating bottom position, the cable 26 is slack. The closure member 13 rests on the bottom 4 of the treatment ladle 2 and the chamber 25 is formed.

By activating the gear motor 28 in one direction, the cable 25 is wound in the reel 27 and pulls the closure member 13 upward moving the closure bell 17, from said isolating bottom position, away from the bottom 4 of the treatment ladle 2 which creates a passage between the frontal edge 22 of the closure bell 17 and the bottom 4 of the treatment ladle 2 and consequently gives rise to the opening of the chamber 25.

By activating the gear motor 28 in the other direction, the cable 26 is unwound from the reel 27 and the closure member 13 drops to the bottom 4 of the treatment ladle 2.

The treatment device 1A may be used in the following manner.

Figure 3:
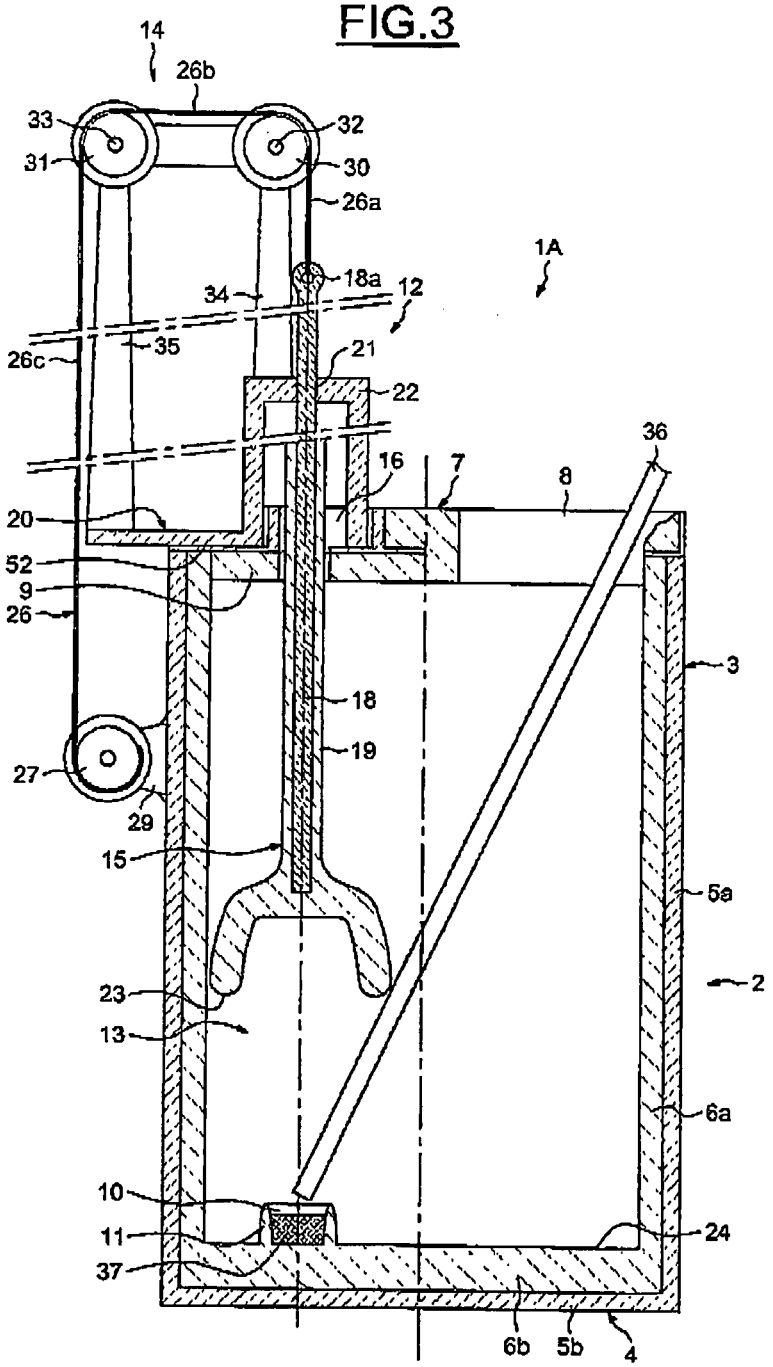
FIG. 3 represents a vertical section of the treatment device from FIG. 1, according to another stage of use.

As illustrated in FIG. 3, the treatment ladle 2 being positioned substantially vertically, the gear motor 28 is actuated so as to lift the closure member 13 with respect to the bottom 4 of the treatment ladle 2, to a sufficient height so that a tubular lance 36 can be introduced into the treatment ladle 2 through its upper opening 8 and be placed in a position such that its lower end is located just above the local cavity 10.

It is then possible to use the tubular lance 36 to introduce into the local cavity 10 a desired amount of an additive agent 37, for example magnesium or a magnesium alloy, in the form of a powder, grains or flakes.

Then the tubular lance 36 is withdrawn.

Next, as illustrated in FIG. 1, the gear motor 28 is activated so as to lower the closure member 13 to said isolating bottom position. When the closure member 13 reaches this position, the isolated chamber 25 is formed and the additive agent 37 is enclosed in this isolated chamber 25.

According to one embodiment variant, a means could be provided for firmly holding the closure member 13 in said isolating bottom position. For example, this holding means could comprise a removable conical wedge put in place manually, passing through the shaft 18 and lugs provided on top of the radial part 22 of the support 20 and on either side of the shaft 18, so as to act downward on the shaft 18. According to another example, this holding means could comprise a controllable actuating member, for example a system having one or more actuators that act downward on a shoulder of the shaft 18 in the isolating bottom position by means of one or more rocker arms, the latter possibly being retracted in order to allow this shoulder to pass when the shaft is moved upward.

The closure member 13 being in said isolating bottom position, a desired amount of a molten metal 38 is poured into the treatment ladle 2 through the upper opening 8.

The pressure of the metal on the closure bell 17 helps to keep the latter bearing against the bottom 24 of the treatment ladle.

If possible leaks of metal penetrate into the chamber 25 by passing through the annular bearing zone 23, these leaks remain contained in the intermediate annular space 25*a* of the chamber 25 and are prevented from reaching the additive agent contained in the cavity 10 owing to the existence of the low wall 11. The low wall 11 thus constitutes an obstacle to any premature reaction.

The upper opening 8 could then be closed by a cover (not represented) added onto or mounted on the cover portion 7 for example in a hinged manner, in order to close the ladle 3 and for example to reduce the heat losses, to limit the projections of metal, to reduce the possible oxidations and to improve the efficiency of the reaction.

Figure 4:
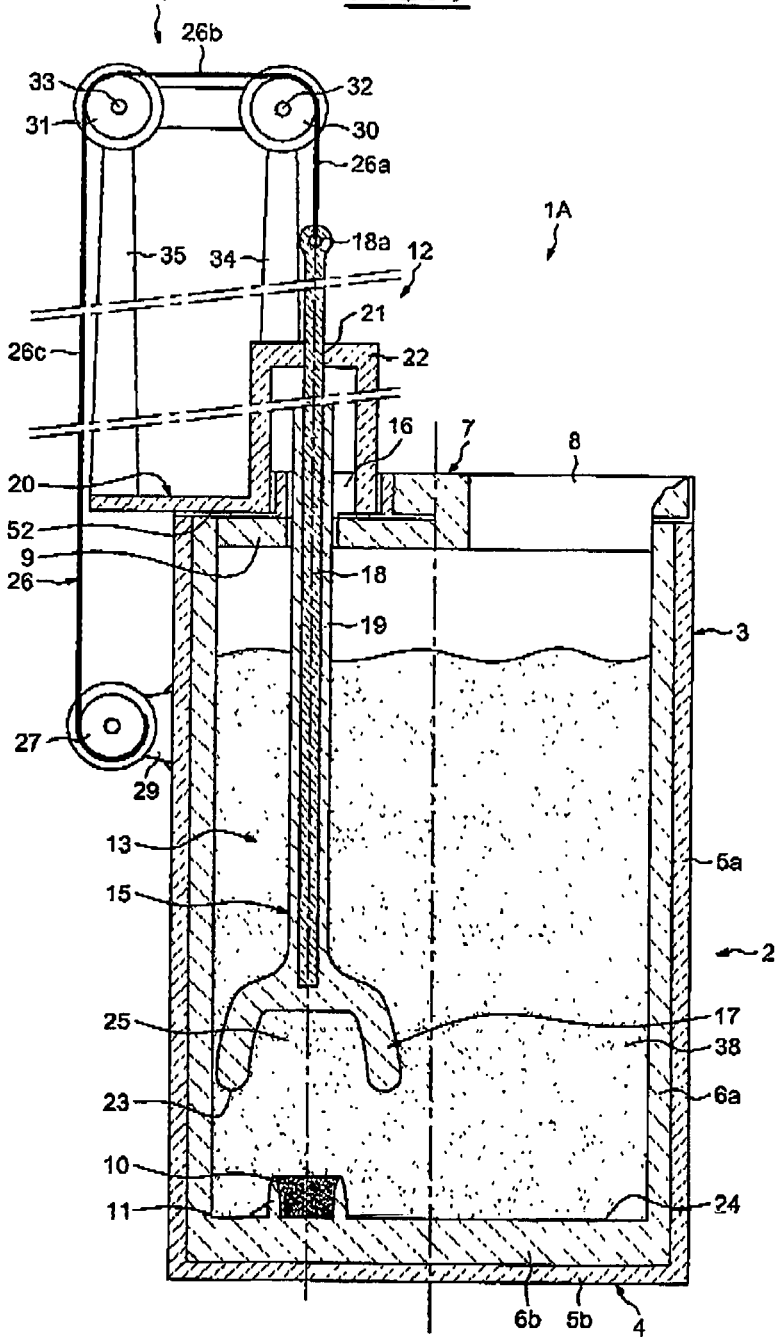
FIG. 4 represents a vertical section of the treatment device from FIG. 1, according to another stage of use.

Next, and at a desired moment, as illustrated in FIG. 4, the gear motor 28 is activated so as to lift the closure member 13. This being done, the molten metal 38 is brought into contact with the additive agent 37. The desired reaction takes place between the molten metal 38 and the additive agent 37.

It is then possible, at a desired moment, to tilt the treatment ladle 2 so as to pour the treated molten metal 38 through its upper opening 8, on the side opposite the cover portion 7, into the cavity of a mold or of several molds with a view to the manufacture of molded metal parts.

During the above operations, the treatment ladle 2 may be carried by a transfer car by means of support and tilting means or may be carried by lifting means such as an overhead cable crane, provided with tilting means, for example cable tilting means.

It results from the foregoing that the time difference, between the moment when the closure member 13 is lifted in order to give rise to the reaction between the additive agent 37 and the molten metal 38 and the moment when the molten metal 38 is poured, may be chosen by the operator and perfectly controlled, this time difference being independent of the prior operations of depositing the additive agent in the local cavity 10 and of filling the treatment ladle 2 with the molten metal 38.

In the case, for example, of a treatment of a molten cast iron by an addition of magnesium or a magnesium alloy, it is desirable that this difference be as short as possible.

Owing to the position of the local cavity 10 at the bottom of the treatment ladle 2, the reaction is initiated in the depth of the molten metal 38, which is favorable to a diffusion of the reaction throughout the volume of the molten metal 38.

Moreover, the metering of the amount of additive agent with respect to the volume of the molten metal to be treated is facilitated and may be precise.

Figure 5:
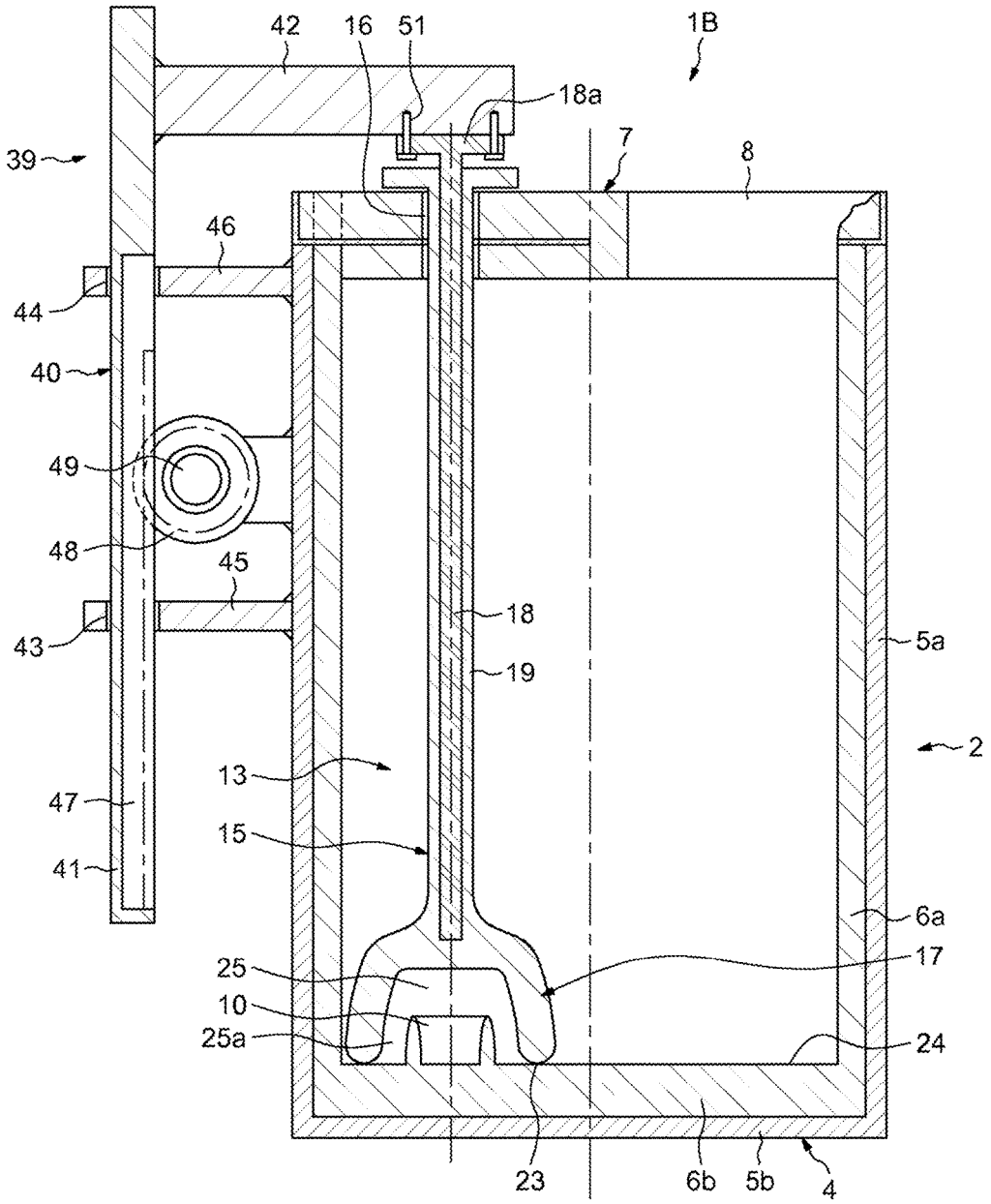
FIG. 5 represents a vertical section of another treatment device, according to one stage of use.
Figure 6:
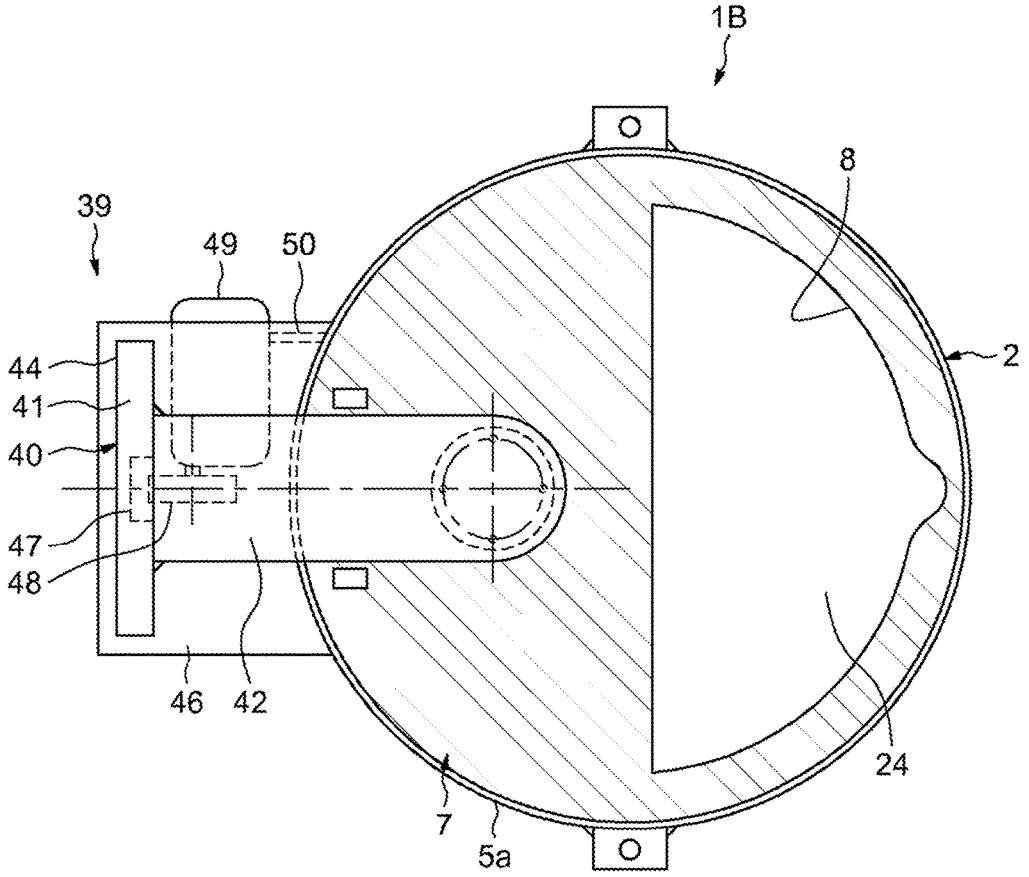
FIG. 6 represents a top view of the treatment device from FIG. 5.

By referring to FIGS. 5 and 6, a treatment device 1B will now be described that differs from the treatment device 1A by displacement means 39 for moving the closure member 13, which replace and are equivalent to the displacement means 14.

The displacement means 39 comprise a slide 40 that comprises a side arm 41 positioned laterally to the treatment ladle 2 and parallel to the axis of the latter and that comprises a radial arm 42 that extends above and at a distance from the cover portion 7.

The side arm 41 passes through guide passages 43 and 44 made through spaced out radial brackets 45 and 46 that are attached against the shell 5*a* of the treatment ladle 2.

The side arm 41 is provided with a rack 47 parallel to the axis of the treatment ladle 2, in contact with a pinion 48 borne by the axle of a gear motor 49 attached to the shell 5*a* of the treatment ladle 2 by means of a bracket 50.

The upper end 18*a* of the shaft 18 of the closure member 13 comprises a plate which is attached underneath the free end portion of the radial arm 42, for example by screws 51, so that the closure member 13 is firmly attached to the slide 40.

When the gear motor 49 is activated, in one direction or the other, the pinion 48 acts on the rack 47 in order to move the slide 40 in translation in one direction or the other, parallel to the axis of the treatment ladle 2, and the slide 40 moves the closure member 13 in one direction or the other.

The displacement means 39 may then be used in an equivalent manner to that which was described above with respect to the displacement means 14 for closing and opening the chamber 25.

Moreover, owing to the rigid connection between the closure member 13 and the rack 47 in contact with the pinion 46, the gear motor 49 may generate a desired force for applying the closure bell 17 against the inner face 24 of the bottom 4 of the treatment ladle 2 over the bearing zone 23, in particular for ensuring the leaktightness of the chamber 25. This application force may be maintained for example owing to a non-reversibility of the gear motor 49.

Figure 7:
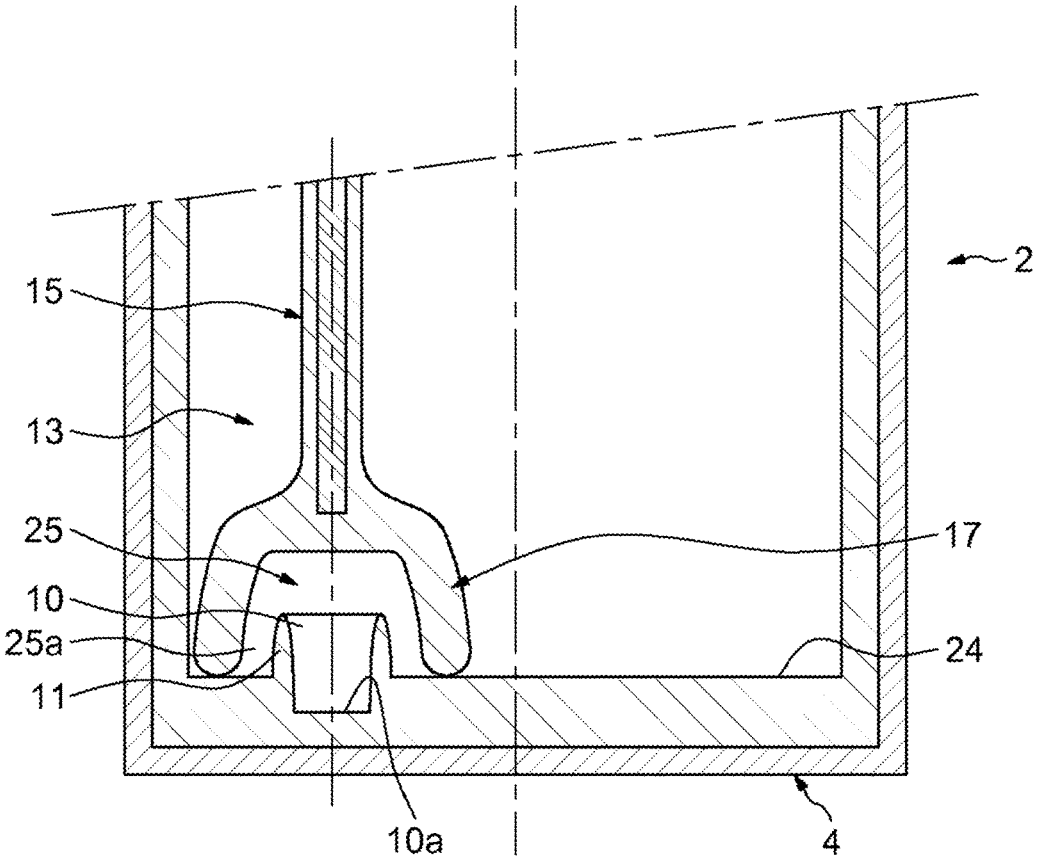
FIG. 7 represents a partial vertical section of an embodiment variant of a treatment device.

According to one embodiment variant illustrated in FIG. 7, the local cavity 10 is deepened so that its bottom 10*a* is at a level below that of the inner face 24 of the bottom 4 of the treatment ladle 2.

According to one embodiment variant, gear motors 28 and 49 could be replaced by actuators which, in the case of the displacement means 14, would be connected to the cable 25 and, in the case of the displacement means 39, would be connected to the slide 40.

According to another embodiment variant, the bearing zone 23 could be covered with a sealing layer made of a refractory material.

According to one embodiment variant, the inner coating 6*b* could have an annular channel between the low wall 11 and the annular bearing zone 23, so as to enlarge the intermediate annular space 25*a*.

The treatment devices and their methods of use which have just been described may be applied without limitation, in particular to the treatment of a cast iron using pure magnesium or a magnesium alloy or to the treatment of a steel using calcium metal, a ferrosilicon or a silicon-calcium alloy or to the treatment of aluminum using an alloy of titanium and of boron or of sodium, generally for an effect on their metallurgical structure.

The present invention is not limited to the examples described above. A good many embodiment variants are possible without departing from the scope of the invention.

The invention claimed is:

1. A process for treating a molten metal or metal alloy using an additive agent, comprising:

depositing the additive agent in at least one local cavity made in a bottom of a treatment ladle and delimited by a low annular wall that protrudes with respect to the bottom;

lowering down to a bottom position at least one closure member comprising a closure bell so that the closure bell surrounds, at a distance, the low annular wall and so that a frontal edge of the closure bell bears against the bottom of the treatment ladle, creating an annular bearing zone around and at a distance from the low annular wall and that is located below an upper edge of the low annular wall, forming a chamber that includes the at least one local cavity;

at least partially filling the treatment ladle with the molten metal or metal alloy; and raising the at least one closure member so as to bring the molten metal or metal alloy and the additive agent into contact.

2. An application of the process as claimed in claim 1, for the treatment of a molten cast iron using pure magnesium or a magnesium alloy.

3. An application of the process as claimed in claim 1, for the treatment of a molten steel using calcium metal, a ferrosilicon alloy, or a silicon-calcium alloy.

4. An application of the process as claimed in claim 1, for the treatment of aluminum or an aluminum alloy using titanium, boron, sodium or an alloy thereof.

5. A device for treating a molten metal or metal alloy using an additive agent, comprising a treatment ladle, wherein at least one local cavity is made in a bottom of the treatment ladle and that comprises added equipment comprising at least one closure member and a displacement assembly for moving the at least one closure member to and from a bottom position for isolating or closing the at least one local cavity;

wherein the bottom of the treatment ladle has a protruding low annular wall that delimits the at least one local cavity;

and wherein a lower portion of the at least one closure member comprises a closure bell which, in said bottom position, is capable of surrounding, at a distance, the low annular wall and a frontal edge of which, in said bottom position, is capable of bearing against the bottom of the treatment ladle, creating an annular bearing zone around and at a distance from the low annular wall and that is located below an upper edge of the low annular wall, so as to form a chamber that includes the at least one local cavity.

6. The device as claimed in claim 5, wherein the at least one, closure member comprises a suspension arm connected to said displacement assembly and a lower portion having a lower annular edge that bears, in said bottom position, against a zone of the bottom of the treatment ladle, extending around the at least one local cavity.

7. The device as claimed in claim 5, wherein the at least one closure member extends through a passage of a cover portion for at least partial closure of the treatment ladle.

8. The device as claimed in claim 5, wherein the added equipment comprises a guide for guiding the at least one closure member.

9. The device as claimed in claim 5, wherein the at least one closure member is rigidly connected to the displacement assembly.

10. The device as claimed in claim 5, wherein the displacement assembly is configured to exert a force for applying the at least one closure member, over the annular bearing zone of the at least one closure member, against the bottom of the treatment ladle.

11. The device as claimed in claim 5, wherein the annular bearing zone of the at least one closure member against the bottom of the treatment ladle is provided with a sealing layer.

* * * * *